United States Patent [19]

Frydrych

[11] 4,243,256

[45] Jan. 6, 1981

[54] NARROW STYLE SURFACE MOUNTED REVERSIBLE LATCH

[76] Inventor: Robert R. Frydrych, 71-54 58th Rd., Maspeth, N.Y. 11378

[21] Appl. No.: 948,005

[22] Filed: Oct. 2, 1978

[51] Int. Cl.[2] ..... E05C 1/16

[52] U.S. Cl. ..... 292/245; 292/169

[58] Field of Search ..... 292/244, 245, 173, 169; 70/462

[56] References Cited

U.S. PATENT DOCUMENTS

| | | | |
|---|---|---|---|
| 1,057,663 | 4/1913 | Page | 292/244 |
| 2,757,033 | 7/1956 | Noca | 292/173 |
| 2,867,466 | 1/1959 | Stroup | 292/244 |
| 4,136,540 | 1/1979 | Coralli et al. | 70/462 X |

FOREIGN PATENT DOCUMENTS

| | | | |
|---|---|---|---|
| 362678 | 12/1931 | United Kingdom | 292/244 |

*Primary Examiner*—Richard E. Moore

*Attorney, Agent, or Firm*—Hubbell, Cohen, Stiefel & Gross

[57] ABSTRACT

A reversible door latch particularly suited for use with narrow style doors. Door latch includes a housing mountable on a door, the housing having confronting side walls, each having an opening therein; a latch member having a latch bolt at one end, the latch member being mountable in the housing in either a first position in which the latch bolt is movable through the opening in one of the side walls or a second position in which the latch bolt is movable through the opening in the other side wall; and a handle rotatably secured to the housing and operatively connected to the latch member for retracting the latch bolt into the housing.

8 Claims, 6 Drawing Figures

NARROW STYLE SURFACE MOUNTED REVERSIBLE LATCH

BACKGROUND OF THE INVENTION

1. Field of the Invention

This invention pertains to surface mounted door latches and more particularly to narrow style surface mounted door latches usable on both right-handed and left-handed doors.

2. Prior Art

Reversible door latches usable on both right-handed and left-handed doors are well known. Some, like those disclosed in U.S. Pat. Nos. 113,097, 248,551, 311,575 and 907,389 achieve reversibility by rotating the latch bolt 180° about its axis and turning the housing upside down. Since latches are conventionally opened by rotating the handle downward, it will be apparent that the handle will be rotated in one direction when the latch is used on a left-handed door and in the opposite direction when the latch is used on a right-handed door. Accordingly, the mechanism connecting the handle to the latch must serve to retract the latch regardless of the direction of rotation of the handle. Such "double-acting" latch retracting mechanisms are more complicated and more expensive than the latch retracting mechanisms found in non-reversible latches. They are also bulky and, therefore, typically require wider housings than those needed for unidirectional latches. This is disadvantageous when use on narrow style doors, such as narrow style aluminum store front doors, is contemplated.

Other latches, such as the one disclosed in U.S. Pat. No. 3,697,106, achieve reversibility by incorporating two latch bolts, one extendible through one side of the housing for use on right-handed doors and the other extendible through the other side of the housing for use on left-handed doors. Like the reversible latches discussed above, such latches are bulky since they require extra space to house the additional latch bolt and the actuating mechanism therefor. The extra latch bolt and actuating mechanism also add to the expense of the latch. Other exemplary reversible latches with similar deficiencies are disclosed in U.S. Pat. Nos. 1,722,583, 2,114,418, 3,797,869 and 3,907,344.

SUMMARY OF THE INVENTION

According to the invention, I have developed a latch usable on both right-handed and left-handed doors that may be accommodated in a relatively narrow housing and which is both reliable and relatively inexpensive to construct. According to the presently preferred embodiment of the invention, the latch includes a housing having confronting side walls, each side wall having an opening therein. A latch bolt is supportable in the housing in one of two positions. In one position the latch bolt is movable through the opening in one of the side walls and in the other position the latch bolt is movable through the opening in the other side wall. A handle is movably secured to the housing and connected to means for effecting movement of the latch bolt upon movement of the handle. Like the latch bolt, the handle and moving means may assume two positions, one for effecting movement of the latch bolt when the latch bolt is positioned for movement through one opening and the other for effecting movement of the latch bolt when the latch bolt is positioned for movement through the other opening. Preferably, the two positions of the latch bolt, handle and moving means are "mirror-image" positions relative to the housing.

It will be apparent that since the latch bolt, moving means and handle are all reversible, there is no need to employ a "double acting" latch retracting mechanism. Moreover, since a relatively simple latch retracting mechanism may be employed, the latch housing may be relatively narrow thus allowing use of the latch on narrow style doors.

Further features and advantages of the latch according to the invention will become more fully apparent from the following detailed description and annexed drawings of the preferred embodiments thereof.

DETAILED DESCRIPTION OF THE PREFERRED EMBODIMENT

Figure 1:
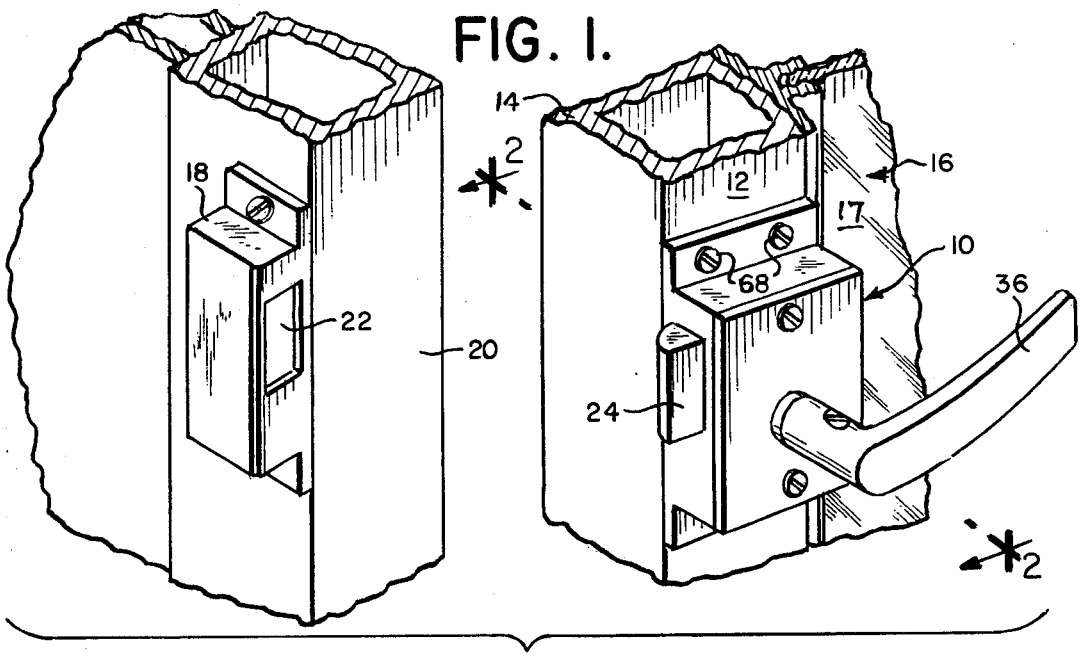
FIG. 1 is a fragmentary perspective view of the preferred door latch in accordance with the present invention and a keeper therefor, the latch and keeper being mounted on a right-handed door and a door jamb, respectively.
Figure 2:
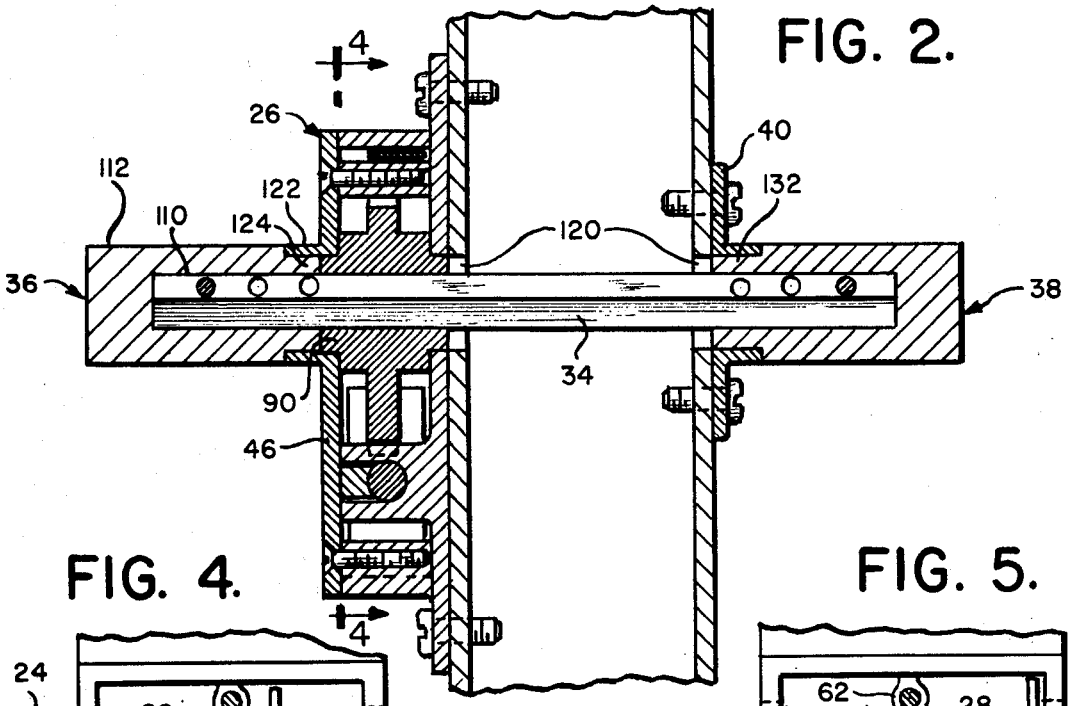
FIG. 2 is a sectional view taken substantially along the lines 2—2 in FIG. 1.
Figures 3, 6:
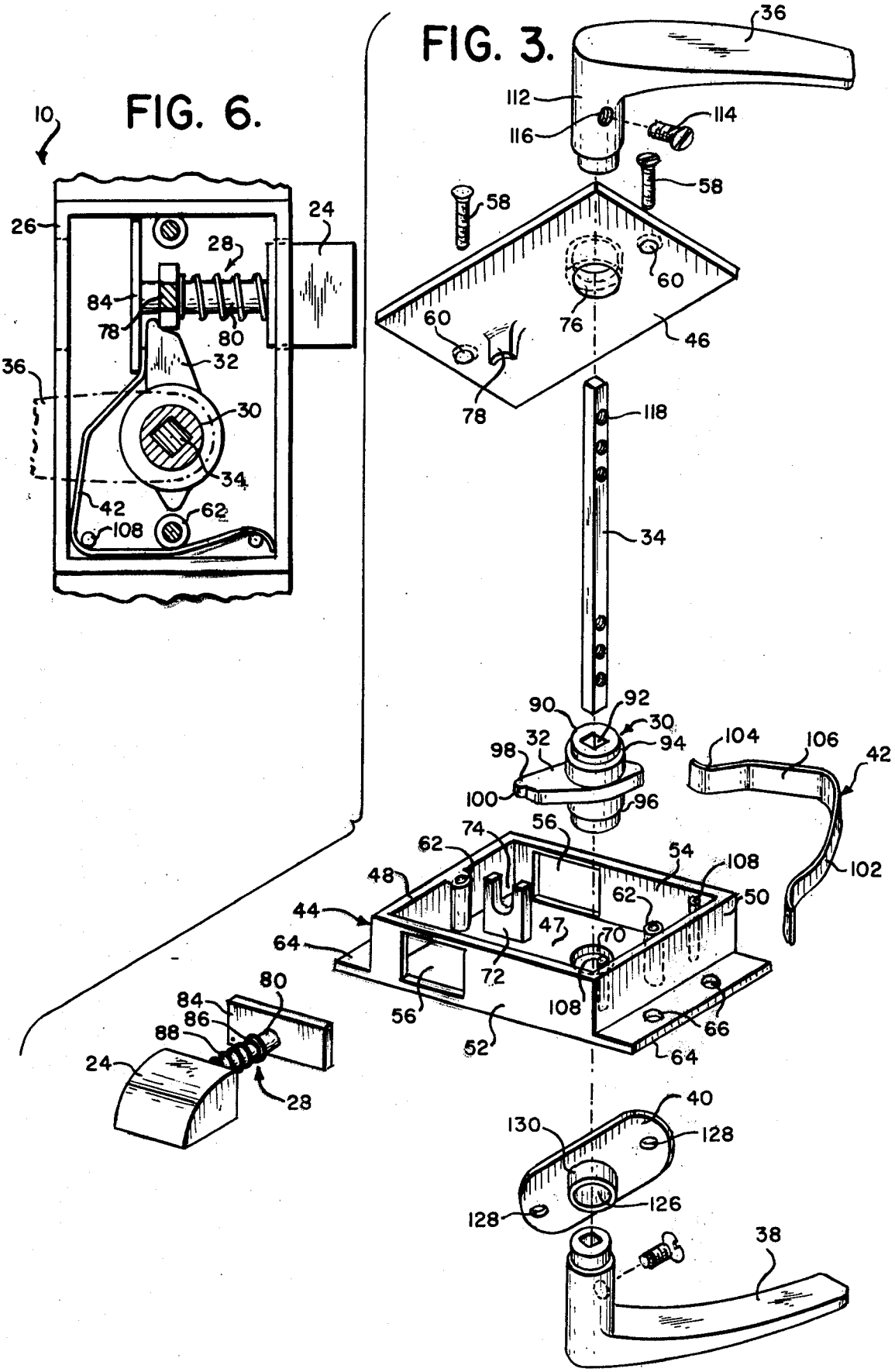
FIG. 3 is an exploded perspective view of the latch illustrated in FIG. 1.
FIG. 6 is a view similar to FIG. 4 but showing the latch assembled for use on a left-handed door.

Referring now to the drawings and initially to FIG. 1 thereof, the preferred reversible latch 10 in accordance with the present invention is shown mounted on the surface 12 of the narrow style body 14 of the right-handed door 16 having a glass interior 17. Also shown is a keeper 18 mounted on a door jamb 20, the keeper having an opening 22 for receiving the latch bolt 24 and holding the door 16 in the closed position. The keeper, which is conventional, forms no part of the present invention. As is best shown in FIGS. 2 and 3, the principal components of the preferred latch 10 are a housing 26, a latch member 28, a hub 30 having a camming member 32 secured thereto, a spindle 34, handles 36 and 38, an escutcheon plate 40 for the handle 38, and a leaf spring 42.

Housing 26 preferably comprises a main portion 44 having a cover plate 46 removably secured thereto. Main portion 44 includes a back wall 47, a top wall 48, a bottom wall 50 and confronting side walls 52 and 54, each side wall having an opening 56 therein. As presently preferred and shown, cover plate 46 is secured to main portion 44 by a pair of screws 58 which extend through a pair of holes 60 in cover plate 46 and are threadably received in a pair of screw posts 62 in main portion 44. A pair of flanges 64 coplanar with back wall 47 are provided for mounting the housing 26 on the door 16, each flange having a pair of holes 66 therein. As best shown in FIG. 1, housing 26 is preferably mounted on the door by screws 68 extending through the holes 66 and into the door body 14. For reasons that will become more fully apparent hereinafter, an opening 70 is provided in back wall 47 and a post 72 extends upwardly from the inner surface of the back wall 47 midway between the openings 56, the post 72 having a generally U-shaped recess 74 in the upper portion thereof. Also for reasons that will be more fully apparent hereinafter, cover plate 46 has an opening 76 and a depending projection 78 aligned with the recess 74 in the post 72. While the housing 26 may be constructed in a variety of ways, main portion 44 and cover plate 46 are both preferably die cast aluminum as this yields a housing which is lightweight, durable and relatively inexpensive.

As presently preferred and shown, the latch member 28 comprises a shaft 80 having the latch bolt 24 secured on one end and a back plate 84 secured on the other end. A washer 86 or similar element such as a C-ring is slidably mounted about the shaft 80 between the latch bolt 24 and the back plate 84 and a coil spring 88 is disposed about the shaft between the washer and the latch bolt. The shaft 80 and the back plate 84 are preferably integrally formed of steel although they may be separately formed and joined together as, for example, by peening the shaft over the back plate. The latch bolt 24 is preferably secured to the shaft 80 by force fitting the shaft in a blind hole (not shown) in the latch bolt, the end of the shaft preferably being knurled to prevent rotation of the latch bolt relative to the shaft. Latch bolt 24 is preferably formed of brass although other suitable materials may be used. Preferably the latch bolt 24 will be coated with nylon or a suitable plastic to reduce the friction between the latch bolt 24 and the keeper 18.

Latch member 28 may be assembled by sliding the washer 86 and spring 88 on the shaft 80 and then force fitting the latch bolt 24 on the end of the shaft. The spring 88 could, however, be placed about the shaft 80 after the latch bolt 24 is already fitted in place. Likewise, if the washer 86 is replaced by a C-ring, it too could be placed on the shaft after the latch bolt is in place. Whatever method of assembly is employed, the length of the coil spring is preferably selected such that when the spring is unflexed (FIGS. 3 and 4), a portion of the shaft between the washer 86 and the back plate 84 is exposed.

As best shown in FIG. 3, the preferred hub 30 comprises a shaft 90 having an axial thru hole 92, the portion of the shaft intermediate its ends being thickened to define a pair of flanges 94 and 96. For reasons that will become apparent as this description progresses, hole 92 is preferably square although other non-circular shapes may also be employed. The camming member or follower 32 is secured to the shaft 90 about its midpoint and has a tooth or cog 98 at one end. As presented preferred and shown, the tooth 98 has a bevelled edge 100 offset from the axis of the shaft 90. The reason for this will be more fully apparent hereinafter. The hub 30 and cam 32 are preferably integrally cast from brass or a brass alloy, although other metals and their alloys may also be employed.

Figure 4:
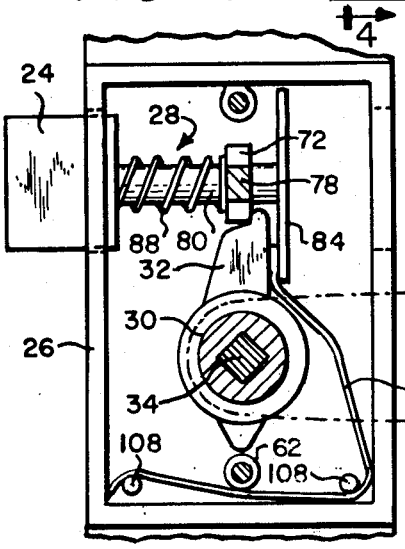
FIG. 4 is a sectional view taken substantially along the lines 4—4 of FIG. 2 showing the latch in the locking position.

Assuming the door latch 10 is to be employed with a right-handed door (FIGS. 1–5), the preferred method of assembly is as follows. First, latch member 28 is disposed in the main portion 44 of the housing 26 with the exposed portion of its shaft 80 seated in the recess 74 of the post 72. As shown, the shaft 80 is dimensioned relative to the width of the housing 26 such that when latch member 28 is in place, latch bolt 24 protrudes through opening 56 in side wall 52 in the locking position (FIG. 4). The assembly comprising the hub 30 and the camming member 32 is then seated by placing the shaft 90 in the hole 70 in the back wall 47 such that the flange 96 seats on the back wall and the bevelled edge 100 of the camming member 32 abuts the side of the post 72 confronting the back plate 84.

The generally V-shaped leaf spring 42 is next disposed in the main portion 44 of the housing 26 in the position shown in FIG. 4. As shown, the spring 42 is dimensioned such that one leg 102 of the spring extends substantially along the wall 50 and the end 104 of the other leg 106 seats between the back plate 84 and the camming member 32. In this position, the leaf spring should be substantially unstressed. For reasons that will become apparent as this description progresses, it is presently preferred and shown that the leg 102 of the spring 42 be held in place by screw post 62 and two additional posts 108 provided for this purpose. Like screw post 62, the posts 108 are preferably integrally cast with main portion 44.

At this point the cover plate 46 is secured to main portion 44 of housing 26 in the manner described above. When thus secured, the depending projection 78 is in the upper portion of the recess 74 in close confronting relation with the exposed portion of the shaft 80. The reason for this will be more fully apparent hereinafter. As is best shown in FIG. 2, when the cover 46 is in place, the flange 94 seats on the inside of the cover plate 46 and the corresponding end of the shaft 90 seats in the hole 76. It will thus be apparent that the assembly comprising hub 30 and camming member 32 is seated for rotation relative to the housing 26. The housing 26 is next secured to the door frame 14 by screws 68 as is more fully described above.

At this point the handle 36 is secured to the spindle 34, preferably by disposing one end of the spindle in an axial blind hole 110 in the short leg 112 of the handle 36 and securing it therein by a set screw 114 which extends through a thru hole 116 in the leg 112 and is received in a blind hole 118 in the spindle. The other end of the spindle 34 is then inserted through the housing via the holes 76, 92, 70 and then through the door body 14 via holes 120 provided for this purpose (FIG. 2). The holes 120 may, for example, be drilled in the door body prior to mounting housing 26 thereon. If this method is adopted, care must be taken when mounting housing 26 to align the hole 70 in the back wall 46 with the holes 120 in the door. The cover plate 46 is desirably provided with a seat 122 for the recessed end 124 of the leg 112 of handle 36 to prevent wobbling of the handle relative to the housing 26 during use.

The escutcheon plate 40 is next secured to the side of the door body 14 opposite the housing 26 such that spindle 34 protrudes through the hole 126 in the escutcheon plate 40. The escutcheon plate 40 may be secured to the door body 14 by, for example, screws (not shown) extending through holes 128 in the plate 40 and into the door. Handle 38 is then mounted on the protruding end of spindle 34 by using the technique described above for mounting handle 36 on the other end of the spindle. Like cover plate 46 and for the same reasons, escutcheon plate 40 is preferably provided with a seat 130 for the recessed end 132 of the handle 38. As best shown in FIGS. 2 and 3, spindle 34 is preferably provided with a plurality of holes for the set screws used to mount the handles as this permits adjustment of the spacing between the handles to accommodate doors of varying widths. Spindle 34 should be non-circular and shaped for a close tolerance fit in the hole 92 whereby rotation of the spindle will rotate the assembly comprising the hub 30 and the cam 32. Thus, as shown, the cross-section of spindle 34, like hole 92, is preferably square. Of course, other arrangements for achieving rotation of the hub and cam assembly upon rotation of the spindle are possible, such alternative arrangements being well known to those skilled in the art.

Figure 5:
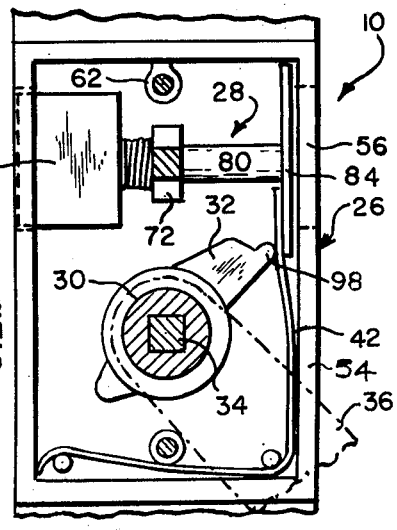
FIG. 5 is a view similar to FIG. 4 but showing the latch in the open or retracted position.

Referring now to FIGS. 1, 4 and 5, and assuming that the latch 10 is initially in the locking position (FIGS. 1 and 4), and the latch bolt is in the keeper 18, it will be apparent that rotation of one of the handles 36, 38 in a downward direction rotates the spindle 34 and hence the hub 30 and cam 32 in a clockwise direction. As the cam 32 rotates, it forces the leg 106 of the leaf spring 42 and hence the back plate 84 towards the sidewall 54 of the housing 26, the shaft 80 being restricted to axial movement by the depending projection 78. When the handle has been sufficiently rotated, the cam 32 will move the leg 106 and hence the back plate 84 into close confronting relation with the side wall 54 (FIG. 5). In this position, the latch bolt 24 is fully retracted into the housing 26 and the coil spring 88 is compressed between the latch bolt 24 and the post 72, the washer 86 serving to prevent the coil spring 88 from unwinding through the recess 74. With the latch bolt 24 thus removed from the keeper 18 the door 16 may be opened.

When the handle is released, the leaf spring 42 urges the camming member 32 and hence the hub 30, spindle 34 and handles 36 and 38 back to their initial positions (FIGS. 1 and 4). As the leg 106 of the leaf spring 42 returns to its initial position, the coil spring 88 urges the latch bolt 24 through the opening 56 until the latch bolt assumes its initial or locking position (FIGS. 1 and 4), the shaft 80 again being restricted to axial movement by the depending projection 78. As the door 16 closes and the rounded edge of the latch bolt 24 strikes the keeper 18, the latch bolt is urged slightly back into the housing against the force of the coil spring 88 until the latch bolt slips by the edge of the keeper, which is preferably bevelled to reduce frictional wear, into alignment with the opening 22. At this point the coil spring 88 urges the latch into the opening 22 and the door is again closed.

With reference to FIG. 6, modification of the latch 10 for use on a left-handed door is accomplished by simply repositioning the latch member 28, the hub 30 and cam 32 assembly, the leaf spring 42 and the handles 36 and 38 to their "mirror image" positions relative to housing 26 as compared with the positions they occupy when the latch is assembled for use on a right-handed door (FIGS. 1–5). Apart from this modification, assembly and operation of the latch 10, whether use on left-handed or right-handed doors is contemplated, is the same. Therefore, a further description of the FIG. 6 embodiment is deemed unnecessary. It will be apparent from a comparison of FIGS. 4 and 6 that the latch is always opened by rotating the handle downward and that the keeper 18 may be used with latch 10 when operated in the left-handed mode by simply turning the keeper upside down.

From the above description of the preferred embodiment of the present invention, those skilled in the art will recognize that the preferred embodiment may be modified without departing from the spirit and scope of the invention. For example, if a key operated version is desired, the outside handle (38 in the drawings) could be replaced by a key operated cylinder rotatably secured to the hub. Alternatively, the latch 10 may be used with a keeper having an electrically releasable locking mechanism. Such locking mechanisms are manufactured, for example, by Trine Manufacturing Co. This would allow a store proprietor, for example, to selectively admit patrons by remote electrical activation of the release mechanism. If this modification is employed, handle 38 could again be eliminated, entry being accomplished by pushing on the door upon release of the locking mechanism.

It will also be apparent that the mechanism for effecting retraction of the latch member 28 upon rotation of the handle may differ from the assembly comprising hub 30 and camming member 32 illustrated in the drawings. Likewise, means other than leaf spring 42 and coil spring 88 may be employed for returning the latch member 28 and handles 36 and 38 to their initial positions. The structure of the housing 26, latch member 28 and handles 36 and 38 may likewise vary. Escutcheon plate 40 may also be modified or, if desired, eliminated altogether.

Since these as well as other modifications and changes are contemplated, the above description should be construed as illustrative and not in a limiting sense, the scope of the invention being defined by the following claims.

What is claimed is:

1. A reversible door latch usable on both right-handed and left-handed doors comprising:

a housing mountable on the exterior of a door, said housing having confronting side walls, each side wall having an opening therein;

a latch member including a latch bolt; means for movably supporting said latch member in either a first initial position in which said latch bolt protrudes through one of said openings or a second initial position in which said latch bolt protrudes through the other of said openings;

a camming member operatively connected to said latch bolt and movable from a first position to a second position for axially moving said latch bolt into said housing through said one opening to a first retracted position when said latch member is in said first initial position and for axially moving said latch bolt into said housing through said other opening to a second retracted position when said latch member is in said second initial position;

a handle rotatably secured to said housing and operatively connected to said camming member, rotation of said handle from an initial position to a final position effecting movement of said camming member from said first position to said second position; and means for biasing said latch member to said initial position, said camming member to said first position and said handle to said initial position.

2. The reversible door latch according to claim 1, wherein said first and second initial latch member positions are mirror image positions relative to said housing.

3. The reversible door latch according to claim 2, wherein said camming member, said handle and said biasing means are mounted in one position relative to said housing when said latch member is in said first initial position and in mirror image positions relative to said housing when said latch member is in said second initial position.

4. The reversible door latch according to claim 3, wherein said handle is rotatable downward for effecting movement of said camming member.

5. The reversible door latch according to claim 4, wherein said means for movably supporting said latch member comprises means secured to said housing for slidably supporting said latch member.

6. The reversible door latch according to claim 5, wherein said means for slidably supporting said shaft comprises a post secured to said housing midway between said side walls, said post having a recess therein, said shaft being slidably supportable in said recess.

7. The reversible door latch according to claim 6, wherein said latch member further comprises a shaft secured at one end to said latch bolt and a back plate secured to the other end of said shaft; wherein said camming member is operatively connected to said back plate; and further comprising a hub operatively connected to said handle for rotation therewith, said camming member being secured to said hub; and wherein a portion of said camming member abuts said post when said latch member is in said first position.

8. The reversible door latch according to claim 7, wherein said biasing means for said latch member comprises a coil spring disposed about said shaft between said latch bolt and said post and said biasing means for said camming member and said handle comprises a leaf spring having one portion secured to said housing and another portion sandwiched between said camming member and said back plate.

* * * * *